US005443115A

United States Patent [19]

Pedersen et al.

[11] Patent Number: 5,443,115

[45] Date of Patent: Aug. 22, 1995

[54] PLATE HEAT EXCHANGER

[75] Inventors: Jorgen Pedersen, Kolding; Soren E. Bogesvang, Lunderskov, both of Denmark

[73] Assignee: APV Baker A/S, Kolding, Denmark

[21] Appl. No.: 178,247

[22] PCT Filed: Jul. 7, 1992

[86] PCT No.: PCT/DK92/00219

§ 371 Date: Mar. 8, 1994

§ 102(e) Date: Mar. 8, 1994

[87] PCT Pub. No.: WO93/01463

PCT Pub. Date: Jan. 21, 1993

[30] Foreign Application Priority Data

Jul. 8, 1991 [EP] European Pat. Off. ..... 91610057

[51] Int. Cl.[6] ..... F28F 3/08

[52] U.S. Cl. ..... 165/70; 165/167

[58] Field of Search ..... 165/70, 167

[56] References Cited

U.S. PATENT DOCUMENTS

| | | | |
|---|---|---|---|
| 3,157,229 | 11/1964 | Wennerberg | 165/167 |
| 4,249,597 | 2/1981 | Carey | 165/166 |
| 4,372,375 | 2/1983 | Bond | 165/70 |
| 4,903,758 | 2/1990 | Cowan | 165/11.1 |
| 4,976,313 | 12/1990 | Dahlgren et al. | 165/167 |

FOREIGN PATENT DOCUMENTS

| | | | |
|---|---|---|---|
| 2454075 | 11/1980 | France . | |
| 3903084 | 8/1990 | Germany | 165/70 |

*Primary Examiner*—Allen J. Flanigan

*Attorney, Agent, or Firm*—Leydig, Voit & Mayer, Ltd.

[57] ABSTRACT

A multi-walled plate element for use in a plate heat exchanger, manufactured by pressing two or more plates, said plate element having a plurality of holes which, when several plate elements are assembled, form distribution channels of a plate heat exchanger. At least some of the holes of the plate element are provided in that one of the walls incorporated in the plate element has a hole cross-section corresponding to the hole concerned of the plate element, and that the other wall or walls incorporated in the plate element have a different hole cross-section. The plate element is assembled with other plate elements to provide a plate heat exchanger. Gaskets (100) are arranged between two plate elements, said gaskets (100) extending along the periphery of the plate elements and around one set of port holes such that the inlet and outlet of a distribution channel can communicate via flow between the two plate elements through the other set of port holes. In respective areas around port holes provided with gaskets (100), the plate element is constructed such that the wall facing the gaskets has a greater hole diameter than the wall facing away from the gaskets. The gaskets (100) are caused to engage both the area around the hole termination on the adjacent wall and the rear side of the other plate.

5 Claims, 5 Drawing Sheets

PLATE HEAT EXCHANGER

Figure 1:
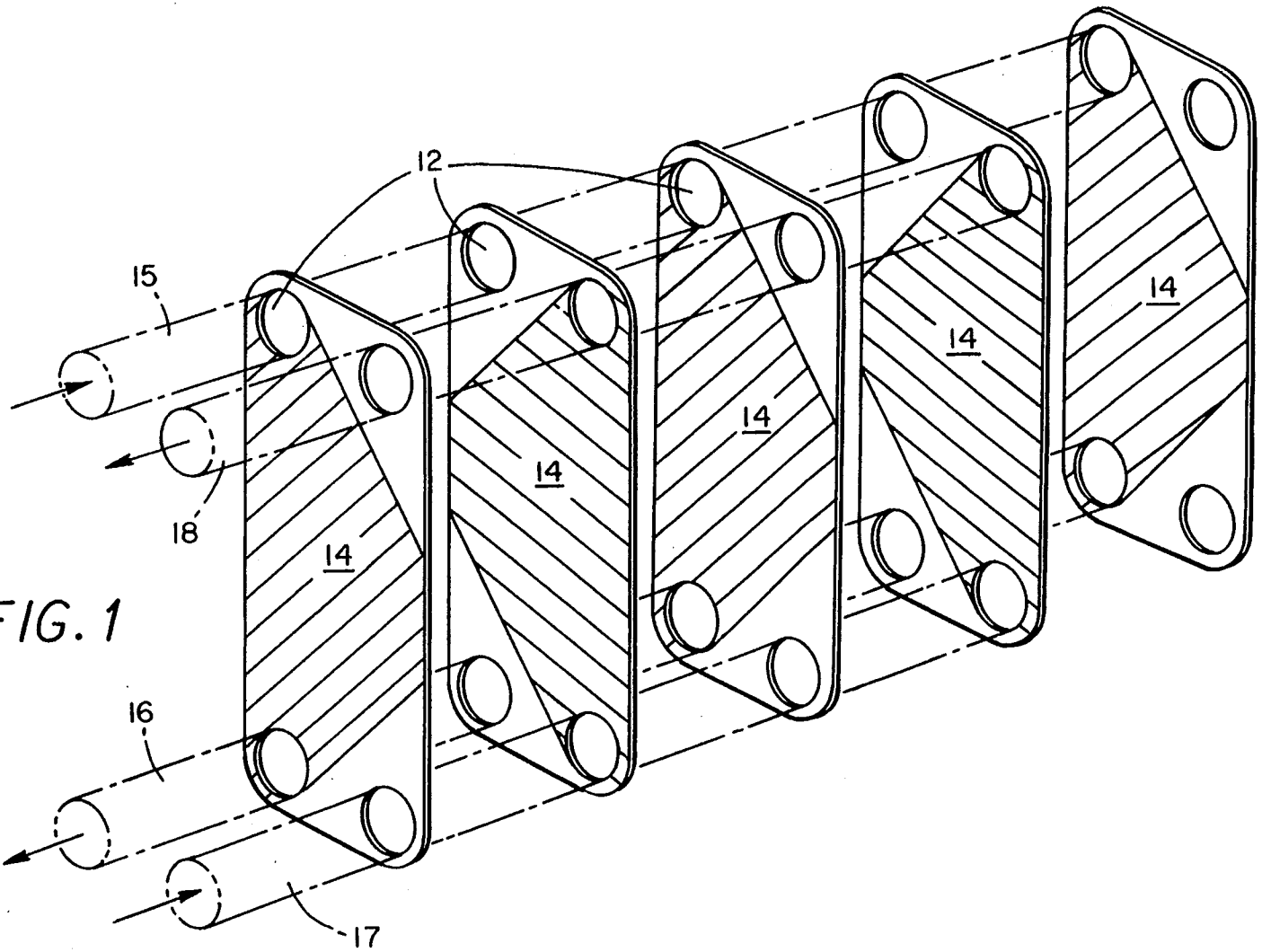

The invention concerns a plate heat exchanger comprising a plurality of stacked plate elements made of multi-layered sheet material, each of said plate elements having a plurality of holes which, when the plate elements are stacked, are aligned to form distribution channels for cavities formed between the stacked plate, with intermediary gaskets arranged between every two adjacent pairs of plate elements at areas which are border the cavities and the aligned holes.

Plate heat-exchangers are used in many process fields where a fluid in liquid or gas form is heated or cooled to a suitable temperature during continuous flow through the plate heat exchanger. When a fluid is to be heated, it is caused to flow through a small passage in the plate heat exchanger, said passage having a large thermal contact face exposed to a heat emitting fluid which preferably passes through the plate heat exchanger in counterflow to the fluid for heating. When a fluid is to be cooled, the other fluid in the heat exchanger is heat absorbing.

This structure is well-known, but has some drawbacks since the individual plate elements are usually made of single-layered sheet material. Corrosion could cause the two fluids of the plate heat exchanger to be mixed, which will be inadmissible. It is therefore necessary to inspect the state of the plate elements regularly, which can only be done by disassembling the plate heat exchanger and inspecting each of the plate elements. This necessitates interruption of the process system in which the plate heat exchangers are used, and is also a very labor intensive routine. Furthermore, the fluids passing through the plate heat exchanger are often very corroding, and this disadvantageous property is additionally intensified by the operating temperature. In case of single-layered plate elements it is thus necessary to select the plate material according to the most aggressive of the fluids, which adds considerably to the material costs.

When a plate heat exchanger is used for e.g. cooling marine engine systems, hot engine water is cooled with cold sea water. As is known, sea water is very aggressive even to stainless steel, and extensive use is therefore made of plate elements manufactured from e.g. titanium or titanium alloys. Other uses of plate heat exchangers will e.g. be in the food industry, e.g. for heating fruit juice.

There is thus a need for a plate heat exchanger where through plate defects can be detected before the fluids in the plate heat exchanger contact each other. In recent years it has been endeavoured to use multi-walled plates as plate elements made of multi-layered sheet material, where in particular the double-layered plate elements are of great interest. Although there is substantial metallic contact, a liquid can leak between the respective sheet layers of the plate elements since the layers are only kept together mechanically, and corrosion of one of the plates can hereby be detected at a relatively early time since the liquid leaks from the leakage to the outer side of the-plate heat exchanger where the liquid can be detected after some time by inspection. It will thus be possible to detect a leakage and remedy such damage before the two different liquids in the plate heat exchanger become mixed.

This technique has a considerable drawback, since the plate elements have port holes so when the plate elements are stacked with gaskets between them to form fluid passages transverse to the plate elements, the rim of the port holes will face said fluid passages. There is thus a need for an effective seal of the rim of the port holes so that fluid from the fluid passages is prevented from leaking between the plate layers of the plate elements. This seal is usually obtained by welding the layers of the plate elements together around the port holes. This solution requires individual welding of the holes of the plate element, which adds to the costs even if welding is performed by a machine. For the sheet layers of a plate element to be welded together, they must have substantially uniform material properties, and it is thus not possible to weld different metals, such as steel and titanium, together. The rough thermal treatment to which the plate elements are subjected around the port holes in the welding process entails that they will be particularly exposed to corrosion in precisely these areas when subsequently used in a plate heat exchanger. This form of sealing of the port holes of the plate elements to prevent leakage of fluid between the individual sheet layers at their terminations will therefore not be suitable for industrial use.

WO-A-88/03253 discloses a plate heat exchanger of the above-mentioned type comprising a double-sheet layer structure where the air gap of low heat exchange between the two sheet layers has been minimized by pressing the two layers together by plastic metal deformation establishing a surface-to-surface contact therebetween. Sealing means in form of a soldered or welded joint interconnects the sheet layer at the rim of the port holes. The plate heat exchanger also comprises intermediary gaskets bordering the cavities for the heat exchanger fluid.

The object of the invention is therefore to provide a plate heat exchanger with multi-layered plate elements which can be assembled without any need for other sealing than the one obtained by the gaskets, which ensure that no corrosion will occur between two adjacent sheet layers of a plate element.

This is obtained by a plate heat exchanger as stated in the characterizing-portion of claim 1.

Hereby is obtained that all of the exposed terminations of the sheet layers are overlayered and safely covered by the gaskets during assembly of the plate heat exchanger. Thereby liquid or gas passing through the plate heat exchanger is never able to penetrate the crevice gaps between individual sheet layers of a plate element. Furthermore, it is possible to separate the individual plate elements and sheet layers in a fast and simple manner for cleaning and inspection purposes.

This provides an assembling procedure which is just as simple as to assemble a plate heat exchanger of single-walled plate elements, while maintaining the advantages associated with multi-walled plate elements. The plate elements are normally manufactured by punching pre-plates to a shape corresponding to the shape of the finished plate element. The port holes of the plate element may expediently be punched after molding of the individual plate layers, since the positions of the holes are controlled best when the other geometry of the plate has been determined. A distribution channel may have an inlet and outlet in the same side of the plate element, i.e. at the same longitudinal edge.

When a gasket is arranged around the hole of a plate element, the gasket covers the annular gap which is formed at the termination of each sheet layer. The gasket moreover has the normal function, viz. to prevent liquid from leaking into the cavity concerned between two plate elements. There will thus be a step on the transition between the two sheet layers incorporated in the plate element, the height of-said step corresponding to the thickness of one sheet. The gasket used for sealing may thus advantageously be formed with a complementary step to ensure better engagement with the plate element.

If it should be found expedient to-use more than two sheets in the plate element, e.g. a stepped structure may be provided in the hole area where a gasket can then expediently be formed with a complementary engagement face.

Figure 2:
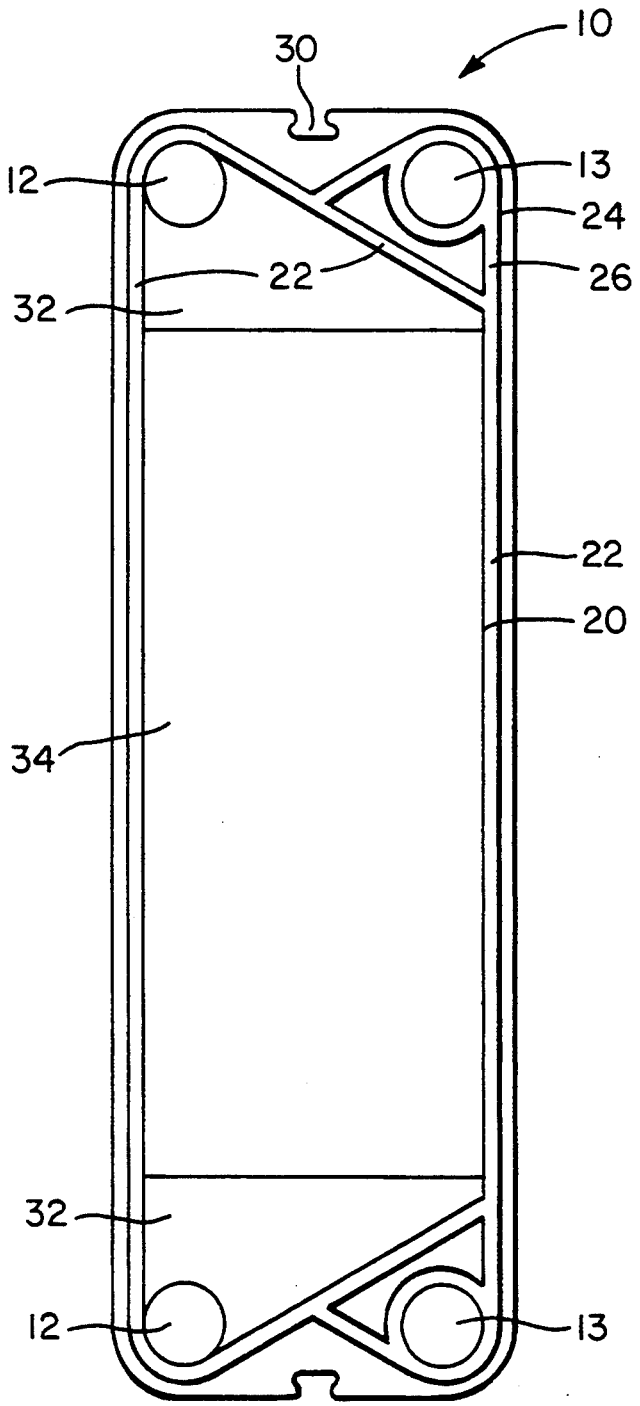
Figure 3:
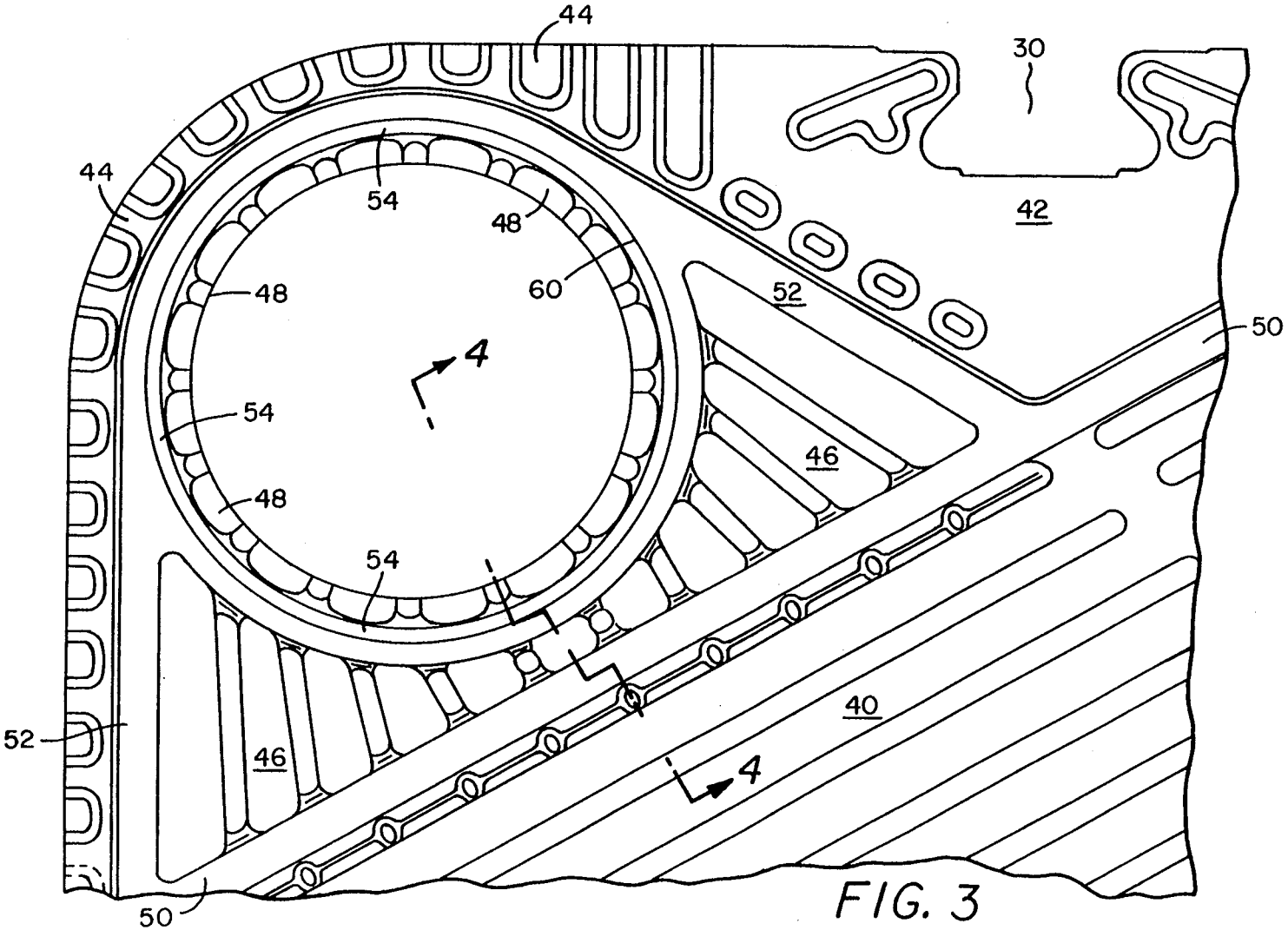
Figure 4:
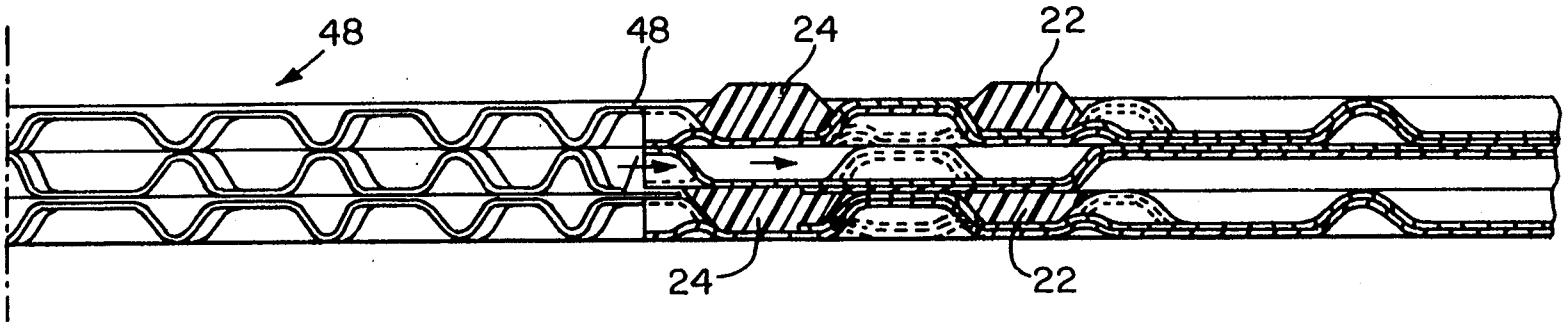
Figure 9:
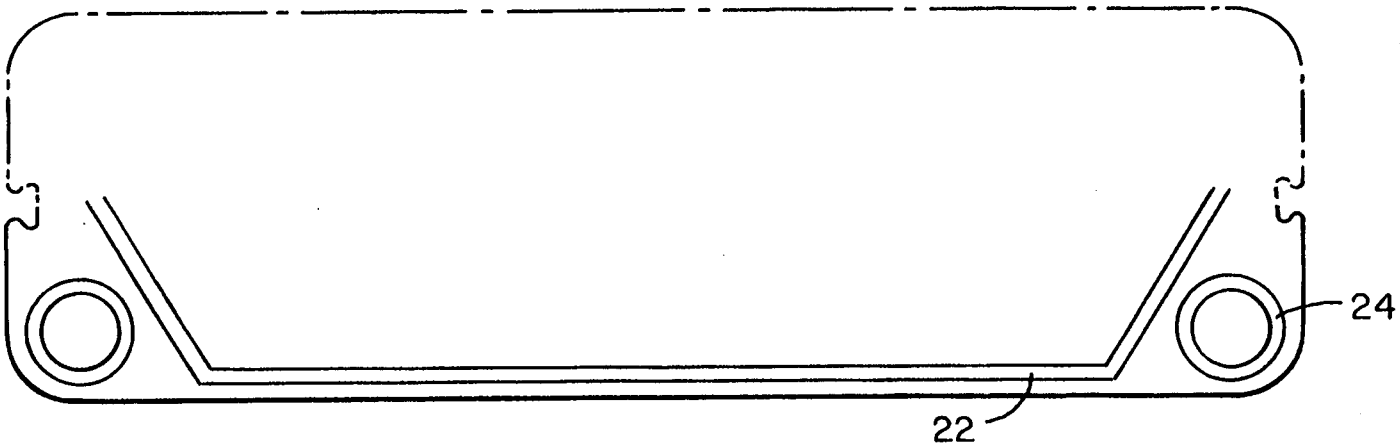
Figure 5:
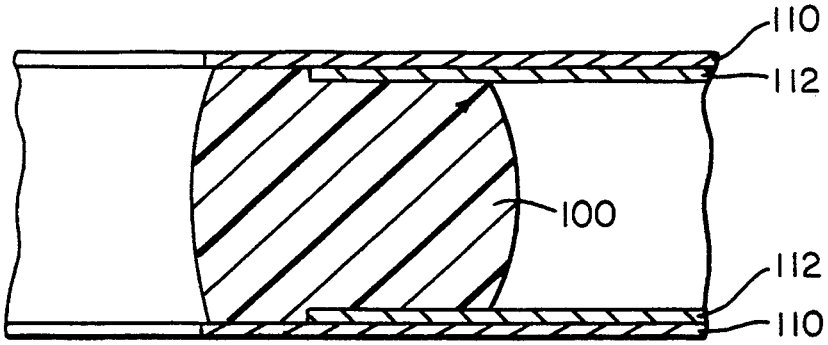
Figure 6:
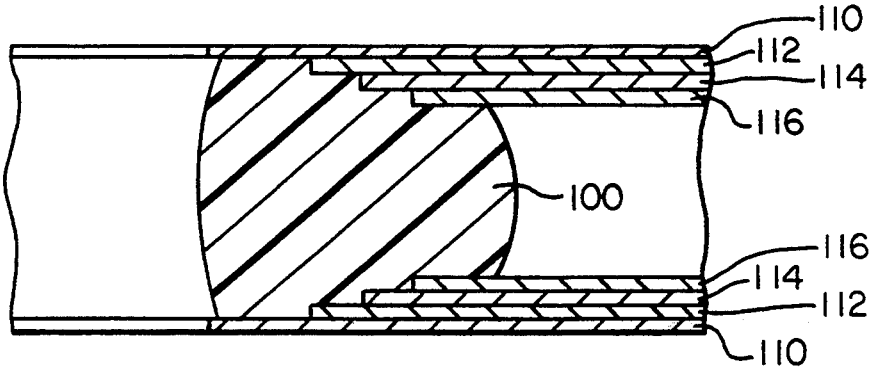
Figure 7:
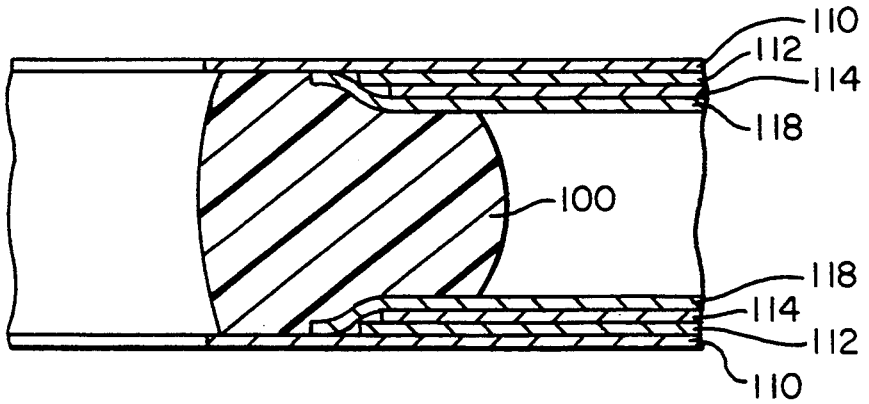
Figure 8:
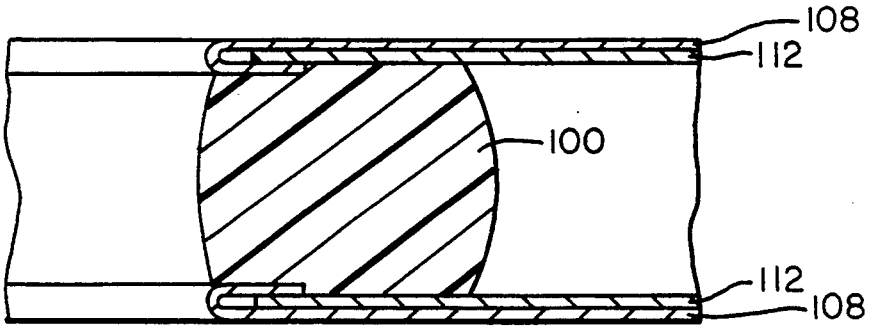

The invention will be explained more fully below in connection with a preferred embodiment and with reference to the drawing, in which FIG. 1 schematically shows how plate elements are assembled to provide a plate heat exchanger, FIG. 2 shows a plate element for a plate heat exchanger, according to the invention, FIG. 3 shows an enlarged section of the plate element shown in FIG. 2, FIG. 4 shows in section how the gaskets are arranged when the plate elements, shown in FIG. 2, are stacked, FIG. 5 schematically shows in section the mounting of a gasket around a corner hole on a preferred embodiment of double-layered plate elements according to the invention, FIG. 6 is a corresponding view of multi-layered plate elements according to the invention, FIG. 7 shows how a gasket seals the gaps between plate bodies in an alternative embodiment of the plate elements according to the invention, FIG. 8 shows an alternative embodiment of double-layered plate elements according to the invention, FIG. 9 shows how the gasket of the plate element can be divided into parts which surround the distribution channels of the plate heat exchanger, and a part which follows the periphery of the plate element.

The function of a plate heat exchanger is shown schematically in FIG. 1. Only the parts necessary to understand the principles are included, for which reason the entire set-up of the plates of the plate heat exchanger and the connection of liquid conduits to the distribution channels of the plate heat exchanger are omitted, and these details will moreover be well-known to a skilled person. The invention will be explained below in connection with a plate heat exchanger composed of substantially rectangular plate elements with four port holes, but it is evident to a skilled person that the shape of the plate elements and the number of the port holes may differ depending upon the use and function of the plate heat exchanger.

FIG. 1 shows five rectangular plate elements 10, which is normally just a small part of the total number of plate elements of a plate heat exchanger. Each of the plate elements 10 has four port holes 12 as well as an area 14 across which fluid or liquid flows, liquid flow being permitted between two plate elements 10 from a distribution channel 15, which is a passage to define the port holes 12 of the plate heat exchanger and is connected to a liquid inlet on the plate heat exchanger for a first liquid, to a distribution channel 16 which is connected with the liquid outlet of the plate heat exchanger for the first liquid. Thus, the first liquid will usually flow through every second one of the cavities formed between the plate elements 10, while a second liquid will flow through the other cavities. There will thus be thermal contact between the two liquids via the plate elements, so that one of the liquids may be cooled or heated by releasing energy to or receiving energy from the other liquid. The other liquid is added through a distribution channel 17 and leaves the plate heat exchanger through a distribution channel 18 after flowing through the cavities formed between the plate elements 10. The two liquids can advantageously flow through the cavities in counterflow, thereby providing the greatest heat transfer.

One of the plate elements 10 shown in FIG. 1 is shown in greater detail in FIG. 2. This figure, like FIG. 1, illustrates a plate element in a plate heat exchanger according to the invention as well as according to the prior art. The plate element 10 is provided with a gasket which is generally designated 20 and which may expediently be secured to the plate element e.g. by gluing or mechanical retention prior to the assembly of the plate heat exchanger. The gasket 20 has a gasket part 22 which substantially follows the periphery of the individual plate element 10 and thus seals the cavity formed between two plate elements upon assembly of the plate heat exchanger. The gasket part 22 permits liquid flow over the plate element 10 from an inlet of a distribution channel to its outlet via two port holes 12. The gasket part 22 also prevents liquid passage from the other port holes 12 to the cavity between the two plate elements. In the embodiment shown the gasket 20 moreover has two ring-shaped gasket parts 24 surrounding and sealing off the port holes 13 which do not communicate with the cavity between the plate elements. The ring-shaped gasket parts are here an integral part of the gasket 20, since they are connected to the gasket part 22 through connectors 26. The connectors 26 may advantageously have portions of smaller thickness than the rest of the gasket 20, thereby ventilating the cavity between the gasket parts 22 and 24 when the plate heat exchanger has been assembled.

Alternatively, as seen in FIG. 9, the gasket 20 may be divided into an annular gasket part 22 and two separate ring-shaped gasket parts 24 so that the gasket part may be made of different materials in sole dependency upon the requirements which the individual gasket parts are to satisfy with respect to resistance to the liquids with which the respective gasket parts are in contact. The material costs may hereby be reduced since the most expensive materials are just to be used where needed.

It will be seen from FIG. 2 how the plate element 10 has a notch 30 which can accommodate a guide rail upon assembly of the plate heat exchanger, thereby ensuring the assembly is correct. The area of the plate element 10 across which the liquid flows, is divided into a central area 34 moulded in a pattern which may e.g. be washboard-shaped, while areas 32 around the port holes 12, 13 are provided with substantially diagonal channels, which does not appear from FIG. 2, but will be well-known to a skilled person and can be deduced from FIG. 3. The moulding of the plate elements serves several functions, including reduction of the flow rate of the liquid to ensure good heat transfer between the liquids, while distributing the pressure from the compression of the plate heat exchanger to the entire cross-section of the plate element.

FIG. 3 shows a detail around a port hole on a double-walled plate element according to the invention. The figure shows an area 40 with straight channels conducting the liquid from a,port hole down to the central area 34 shown in FIG. 2. When two plate elements are pressed together, these channels intersect each other, whereby the liquid is distributed transversely to these channels. Around the cut 30 there is an area 42 where no liquid passes and which is disposed outside the Gasket 20 (FIG. 2). This area has some elevations owing to pressure relief and merges into a rim area 44, which is likewise disposed outside the gasket and is bent into wave-shape.

The plate element is manufactured with a contiguous, plane gasket area comprising straight channels 50, which are adapted to receive the annular gasket part 22 (FIG. 2), as well as a secondary channel 54 in which the ring-shaped gasket part 24 is placed. The gasket area also comprises two connecting channels 52 in which the connectors 26 are accommodated if the gasket is of the type shown in FIG. 2. An area 46 between the gasket channels is provided with radial channels to stiffen the area around the port hole 12. The rim 48 of the port hole 12 is wave-shaped, which is important for a multi-layer plate element according to the invention, it being seen that one wall of the plate element is terminated at a distance from the edge of the port hole. The wall facing the gasket has a termination or an edge 60 which is disposed preferably centrally in the ring-shaped gasket channel 54, for which reason the actual rim 48 is single-layered and is therefore reinforced by the moulding. Since one wall is terminated centrally in the ring-shaped gasket channel 54, the existing gasket may be used for sealing the gap between the sheet layers and the double-layered plate elements. The liquid is hereby prevented in simple manner from leaking from the distribution channels between the sheet layers of the plate element. It will thus be possible to produce the plate elements of two different plate sheet materials which cannot be welded together or sealed in another manner at the port holes by means of known techniques.

FIG. 4 shows in section how the plate elements are assembled, which is shown for a section around a port hole. The wave-shape of the rim 48 is illustrated, and it will be seen how the pressure relief takes place. The figure shows how the gasket 24 prevents liquid from leaking from the distribution channel to partly the cavity between the two plate elements, partly between the individual sheet layers in the plate element. The gaskets 24, 26 are shown to be elastic, so that they are deformed when pressed together to provide a good seal. It is correspondingly seen how liquid can pass from the distribution channel to the cavity formed between the plate elements, which is shown with arrows.

FIGS. 5–8 schematically show Various ways of obtaining a tight seal at port holes for multi-layer plate elements. The actual rim 48 (FIG. 3) is omitted for clarity, so that FIG. 5 corresponds to the preferred embodiment of the plate element of the invention explained in connection with FIGS. 3 and 4. The embodiment shown in FIG. 5 has double-walled plate elements, where the wall 112 facing the gasket 100 has a greater hole diameter than the wall 110 facing away from the gasket. A stepped structure is thus formed so that the gasket 100 can advantageously have complementary engagement faces with a corresponding, complementary stepped structure, if the height of the step is great, i.e. more than 0.2–0.5 mm, and if the gasket material is too stiff to provide a good seal.

FIG. 6 shows four-layered plate elements, where the walls 110–116 have an increasing hole diameter toward the gasket 100 which here advantageously has complementary engagement faces corresponding to the step shape formed by the walls. This structure is of interest if the outer sheet layers are to be made of corrosion resistant materials, such as noble metals, titanium and the like, for which reason the wall thicknesses are to be minimized owing to the material costs. One or more central walls capable of carrying the assembled plate element are therefore needed. FIG. 7 shows a variant of the embodiment shown in FIG. 6 where a sheet layer 118 extends inwardly over the layers 112 and 114, so that the actual gasket area is terminated like in the embodiment shown in FIG. 5.

FIG. 8 shows an embodiment where a sheet layer 108 is bent and overlaps the wall 112 facing the gasket 100. This embodiment necessitates that the layer 108 is made of a bendable material with suitable properties, e.g. plastics or ductile, elastic metals.

We claim:

1. A plate heat exchanger comprising a plurality of stacked plate elements, each of said stacked plate elements comprising at least two sheets of material which separate heat exchanging fluids to thus form a leakage space and prevent intermingling of said fluids in the event of a void forming in one of the sheets, each of said plate elements having a plurality of holes which, when the plate elements are stacked, are aligned to form distribution channels for cavities formed between said stacked plate elements, intermediary gaskets arranged between every two adjacent pairs of plate elements at areas which border the cavities and the aligned holes, such that in respective areas bordering the holes and which are overlayered by the gaskets, the plate elements are constructed such that the sheet layer of a plate element being the most distant layer from a gasket has a smaller hole diameter than the sheet layers nearest to the gasket and in the other areas bordering the cavities the plate elements are constructed such that the terminations of the respective sheet layers of a plate element are staggered to be overlayered by the gaskets.

2. A plate heat exchanger according to claim 1, wherein the gasket arranged between each pair of two opposed plate elements and surrounding a distribution channel is an integral part of a gasket extending along the periphery of two plate elements.

3. A plate heat exchanger according to claim 1, wherein the gasket arranged between two opposed plate elements and surrounding a distribution channel is provided with a step-shaped cross-section corresponding to the wall terminations of the plate elements.

4. A plate heat exchanger according to claim 1, wherein the gasket, which is provided between two opposed plate elements and surrounds a distribution channel is based from and made of another material than a gasket extending along the periphery of two plate elements.

5. A plate heat exchanger according to claim 2, wherein the gasket arranged between two opposed plate elements and surrounding a distribution channel is provided with a step-shaped cross-section corresponding to the wall terminations of the plate elements.

* * * * *